US011713884B2

(12) United States Patent
Schmöller et al.

(10) Patent No.: US 11,713,884 B2
(45) Date of Patent: Aug. 1, 2023

(54) DEVICE FOR OPERATING A BUILT-IN KITCHEN APPLIANCE

(71) Applicant: Wilhelm Bruckbauer, Neubeuern (DE)

(72) Inventors: Anton Schmöller, Kufstein (AT); Walter Könneker, Rosenheim (DE)

(73) Assignee: Wilhelm Bruckbauer, Neubeuern (DE)

( * ) Notice: Subject to any disclaimer, the term of this patent is extended or adjusted under 35 U.S.C. 154(b) by 1174 days.

(21) Appl. No.: 16/333,755

(22) PCT Filed: Sep. 7, 2017

(86) PCT No.: PCT/EP2017/072478
§ 371 (c)(1),
(2) Date: Mar. 15, 2019

(87) PCT Pub. No.: WO2018/050542
PCT Pub. Date: Mar. 22, 2018

(65) Prior Publication Data

US 2019/0257525 A1 Aug. 22, 2019

(30) Foreign Application Priority Data

Sep. 16, 2016 (DE) ..... 10 2016 217 724.9

(51) Int. Cl.
*F24C 7/08* (2006.01)
*H01H 3/08* (2006.01)

(52) U.S. Cl.
CPC ..... *F24C 7/083* (2013.01); *F24C 7/08* (2013.01); *H01H 3/08* (2013.01); *H01H 2231/012* (2013.01); *H01H 2239/006* (2013.01)

(58) Field of Classification Search
CPC . F24C 15/20; F24C 7/083; F24C 7/08; H01H 2239/006; H01H 3/08; H01H 2231/012; H01H 2219/00; H01H 2219/014; H01H 2219/016; H01H 2219/036; H01H 2219/037; H01H 2219/039; H01H 2219/04; H01H 2221/01; H01H 2223/01; H01H 2223/012; H01H 2223/014; H01H 2223/024; H01H 2223/028; H01H 2223/03; H01H 2009/02; H01H 2009/16; H01H 2009/161; H01H 2009/186; H01H 2009/187; H01H 2019/00; H01H 2019/02;
(Continued)

(56) References Cited

U.S. PATENT DOCUMENTS 6,198,175 B1 * 3/2001 Kalb ..... B60N 2/0228 318/671
2007/0181410 A1 * 8/2007 Baier ..... F24C 7/082 200/17 R
(Continued)

FOREIGN PATENT DOCUMENTS

CN 101799702 A 8/2010
CN 201688474 U 12/2010
(Continued)

*Primary Examiner* — Anthony R Jimenez
(74) *Attorney, Agent, or Firm* — McGlew and Tuttle, P.C.

(57) ABSTRACT

An operating device for a built-in kitchen appliance includes a central piece, an operating element mounted rotatably on the central piece, at least one position sensor, which is designed for sensing a rotational position of the operating element, and at least one touch-sensitive and/or pressure-sensitive sensor.

8 Claims, 4 Drawing Sheets

(58) Field of Classification Search
CPC ..... H01H 2019/14; H01H 2207/032; H01H 2207/034; H01H 2217/032; H01H 3/00; H01H 3/10; H01H 3/12; H01H 9/16; H01H 9/161; H01H 9/165; H01H 9/18; H01H 9/181; H01H 9/182; H01H 9/185; H01H 9/20; H01H 9/22; H01H 71/00; H01H 71/02
USPC ..... 219/482
See application file for complete search history.

(56) References Cited

U.S. PATENT DOCUMENTS

| | | | | |
|---|---|---|---|---|
| 2010/0319479 | A1* | 12/2010 | Sjolin | G05G 1/10 74/504 |
| 2013/0032456 | A1* | 2/2013 | Nakajima | H01H 19/11 200/336 |

FOREIGN PATENT DOCUMENTS

| | | | |
|---|---|---|---|
| CN | 205505101 | U | 8/2016 |
| CN | 106094973 | A | 11/2016 |
| DE | 103 04 985 | B3 | 7/2004 |
| DE | 20 2009 009 727 | U1 | 10/2009 |
| DE | 10 2009 022 339 | A1 | 11/2010 |
| DE | 10 2009 025 038 | A1 | 12/2010 |
| DE | 10 2009 048 494 | A1 | 4/2011 |
| DE | 10 2010 039 560 | A1 | 2/2012 |
| EP | 1 775 650 | A2 | 4/2007 |
| EP | 2 214 187 | A2 | 8/2010 |
| EP | 1 944 553 | B1 | 11/2010 |

* cited by examiner

DEVICE FOR OPERATING A BUILT-IN KITCHEN APPLIANCE

CROSS REFERENCE TO RELATED APPLICATIONS

This application is a United States National Phase Application of International Application PCT/EP2017/072478 filed Sep. 7, 2017 and claims the benefit of priority under 35 U.S.C. § 119 of German Patent Application Serial No. DE 10 2016 217 724.9 filed Sep. 16, 2016, the entire contents of which are incorporated herein by reference.

FIELD OF THE INVENTION

The invention relates to a device for operating a built-in kitchen appliance, in particular an operating element, in particular in the form of a rotary knob. The invention also relates to a hob device with such an operating device and at least one hob. Finally, the invention relates to a hob extractor system with such an operating device.

BACKGROUND OF THE INVENTION

Hobs are usually operated by means of touch-sensitive controls (known as touch zones) or by means of rotary knobs. Corresponding hob systems are known for example from DE 10 2009 025 038 A1 and EP 1 944 553 B1. An operating knob for operating a hob is known from DE 20 2009 009 727 U1.

SUMMARY OF THE INVENTION

An object of the present invention is to improve a device for operating a built-in kitchen appliance, in particular an operating element, in particular in the form of a rotary knob.

This object is achieved by a device for operating a built-in kitchen appliance with a central piece, an operating element mounted rotatably on the central piece, at least one position sensor, which is designed for sensing a rotational position of the operating element and at least one touch-sensitive and/or pressure-sensitive sensor, wherein, for flexible arrangement in a front of a kitchen unit or in a kitchen worktop, the central piece is formed by a mounting box, wherein the central piece has an installation receiving space for receiving electrical components, in which the at least one sensor is arranged, and wherein the operating element is designed in the form of a ring. Here, this is in particular an operating element, in particular a so-called rotary knob.

The essence of the invention is to design the device for operating the built-in kitchen appliance with a central piece, an operating element mounted rotatably on the central piece, at least one position sensor, which is designed for sensing a rotational position of the operating element, and at least one touch-sensitive and/or pressure-sensitive sensor.

This makes it possible to improve the functionality of the device, in particular to broaden it.

The device is in particular mechanically actuable. It also has a touch functionality.

The device is in particular a separate component, which can be connected to the built-in kitchen appliance to be operated, in particular to a hob or an extractor fan. The device is designed in particular as a separate built-in module, in particular for being built into a front of a kitchen unit or into a kitchen worktop. Its arrangement in relation to the built-in kitchen appliance to be operated can consequently be chosen with a degree of flexibility.

According to a further aspect of the invention, the device comprises a central piece to be arranged in a front of a unit of furniture. The central piece is formed in particular by a mounting box with an installation receiving space. It preferably has an external-thread ridge portion. This results in a particularly easy and flexible arrangement of the central piece in a front of a unit of furniture or a kitchen worktop.

The central piece is preferably produced at least in certain regions from plastic. It is in particular produced from an electrically insulating material. It is in particular designed as dimensionally stable.

The central piece may be arranged in or on a piece of furniture. It may in particular form a leading-through and/or fixing means for the arrangement of the operating device on a piece of furniture.

It may for example be arranged in a kitchen worktop. The central piece may penetrate the hob level. Preferably, the central piece protrudes upward beyond the hob level. The central piece may alternatively be arranged on the front of a unit of furniture. Preferably, the central piece penetrates the front of the unit of furniture. In particular, the central piece protrudes outward beyond the front of the unit of furniture.

The central piece may have a bearing seat for the rotatable mounting of the operating element. Preferably, the bearing seat is arranged on the region of the central piece that rises up above the hob level or the front of the unit of furniture. The operating element may be mounted in the bearing seat of the central piece. It is advantageously achieved in this way that the operating element is securely attached to the central piece.

The central piece may have a longitudinal axis. Preferably, the central piece is designed as essentially rotationally symmetrical in relation to the longitudinal axis. The operating element may be mounted on the central piece only rotatably about the longitudinal axis and/or displaceably along the longitudinal axis.

Preferably, the operating element is mounted on the central piece in such a way that it is secured against displacements transversely in relation to the axis of rotation. It may in particular have at most a single translatory degree of freedom, in particular in the direction of the axis of rotation. It may in addition to this have in particular a rotatory degree of freedom.

Preferably, the operating element is arranged contactlessly in relation to the hob level and/or in relation to the front of the unit of furniture. A sealing element may be arranged between the hob level and/or the front of the unit of furniture and the operating element.

The at least one position sensor is preferably arranged in the central piece. The central piece is preferably fixedly connected to the built-in kitchen appliance, in particular fixedly in terms of rotation. It is advantageously achieved by the arrangement of the position sensor in the central piece that a signal connection can take place particularly easily.

According to one aspect of the invention, the at least one position sensor serves for sensing a rotational position of a rotatably mounted operating element, in particular in the form of a rotary ring, which is also referred to as a knob ring.

A magnetic sensor, in particular a Hall sensor, serves in particular as the position sensor. In particular, a number of such sensors may be provided. The magnets interacting with the Hall sensors are arranged in particular in the rotatably mounted operating element. The actual Hall sensors are arranged in particular in a central piece of the operating device. The Hall sensors may be arranged in an encapsulated and/or potted manner. They may in particular be arranged on a printed circuit board.

According to one aspect of the invention, the operating element is designed in the form of a ring. The operating element designed in the form of a ring may be arranged concentrically in relation to the longitudinal axis. This would advantageously achieve the effect that the front region of the central piece remains uncovered by the operating element.

According to a further aspect of the invention, the at least one touch-sensitive and/or pressure-sensitive sensor is in signal connection with an operating zone, which is circumferentially surrounded by the operating element. A simple touch-sensitive or pressure-sensitive switch may serve as the operating zone. Preferably, the operating zone is designed as a touchscreen (touch-sensitive screen), in particular as a touchscreen with a TFT display. This allows a more complex functionality to be achieved. Preferably, the at least one touch-sensitive and/or pressure-sensitive sensor is arranged in the central piece and/or is connected to it in a rotationally fixed manner. Preferably, the operating zone is also arranged in the central piece and/or is connected to it in a rotationally fixed manner. This advantageously achieves the effect that a rotation of the operating element with respect to the operating zone and/or with respect to the at least one touch-sensitive and/or pressure sensitive sensor is ensured.

The touch-sensitive sensor can be operated in particular by touching with a finger. It may also be envisaged to provide a special input element, for example in the form of a stylus, for operating the operating zone. This allows for example the operational reliability to be increased. It is in particular possible to prevent the device from being undesirably operated inadvertently by touching the operating zone.

Alternative or additional measures for safeguarding the device against undesired inadvertent operation are similarly possible.

By means of the touch-sensitive sensor, essentially any desired functions of the hobs and/or of the extractor fan can be controlled. Further functionalities, such as the operating of a timer, lighting, a radio or other controllable devices are also possible.

The operating element is arranged on the central piece. According to one aspect of the invention, the rotatably mounted operating element can be removed from the central piece, in particular can be removed without a tool. This facilitates the cleaning of the operating element. Removability of the operating element can also serve for making it childproof.

When the operating element is removed from the central piece, the latter may remain in the piece of furniture. The central piece has in particular a surface that is closed toward the operating element.

According to one aspect of the invention, an installation receiving space is enclosed by the central piece. This serves in particular for receiving electrical, in particular electronic components. According to one aspect of the invention, the at least one touch-sensitive sensor is arranged in the central piece, in particular in the receiving space.

A control, in particular electronic components of a control device, for example a printed circuit board, may preferably be arranged in the receiving space. The printed circuit board may be exchangeable. This allows the flexibility of the operating device to be increased further. It is possible in particular to provide a standardized operating device for operating different built-in kitchen appliances. The control device arranged in the receiving space, in particular the printed circuit board, may be selected here in dependence on the properties of the built-in kitchen appliance to be operated.

The installation receiving space may in particular be closed off from the outside in a liquid-tight manner. As a result, the electronic components inside the receiving space are protected particularly reliably.

According to a further aspect of the invention, the device comprises an interface device for the signal-transmitting connection to the built-in kitchen appliance to be operated, in particular for the signal-transmitting connection to a hob and/or an extractor fan device.

The interface device may have one or more interfaces. They are preferably standardized interfaces. For example, they may be RJ plug-in connections, in particular RJ45 plug-in connections, or one or more edge card plug-in connections.

According to a further aspect of the invention, the operating device comprises a display device for displaying at least one operating parameter for operating the built-in kitchen appliance. The display device may in particular comprise one or more display elements. It may in particular comprise a number of display segments and/or display points. It may in particular comprise one or more seven-segment displays.

By means of the display device, a control parameter for controlling the built-in kitchen appliance and/or an operating parameter sensed by means of a sensor, in particular an operating state, for example the current temperature of an oven plate, may be displayable. The display device may also serve for displaying a time of day, a timer or other items of information.

A further object of the invention is to improve a hob device.

This object is achieved by a hob device with at least one hob and an operating device according to the previous description.

The advantages follow from those of the operating device.

The hob and the operating device are in particular designed as separate components. The hob to be operated may in particular be brought into signal connection with the operating device by means of the previously mentioned interface device. The hob and the operating device may in particular be designed as separate modules.

The operating device can preferably be combined with a selection of different hobs.

According to an alternative, the operating device may also be integrated in the hob. The hob device in this case forms an assembly unit.

A further object of the invention is to improve a hob extractor system. This object is achieved by a hob extractor system with a built-in kitchen appliance and an operating device according to the previous description.

The built-in kitchen appliance comprises at least one hob and/or at least one extractor device for extracting cooking fumes. The extractor device is preferably a downdraft extractor fan, that is to say an extractor fan device for extracting cooking fumes in a downward direction. Such extractor devices are also referred to as downdraft extractors.

According to one aspect of the invention, the hob extractor system has a modular construction. This should be understood as meaning that different modules, in particular different hobs and/or extractor devices, can be combined essentially freely with one or more operating devices.

According to a further aspect of the invention, the hobs and/or extractor devices are automatically detected by the operating devices. The operating devices configure themselves, in particular automatically. As an alternative to this, it may be envisaged to select the control device that is required for operating a selected built-in kitchen appliance in dependence on the latter. It may in particular be arranged in the central piece of the operating device. It may also be provided as a separate module.

According to a further aspect of the invention, the at least one hob is exchangeable. It is in particular freely selectable from different alternatives. In particular, all conceivable alternatives come into consideration for the hob.

According to a further aspect of the invention, the hob extractor system comprises a plurality of hobs and one or more extractor devices for extracting cooking fumes, one of the devices for operating the built-in cooking appliance in each case being in signal connection respectively with one of the hobs and/or at least one extractor device for extracting cooking fumes.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

In the following, first the general components of a hob extractor system 1 are described. The hob extractor system 1 comprises at least one hob 2. In the case of the hob extractor system 1 that is represented by way of example in FIG. 1, two hobs 2 are provided.

The hobs 2 may be essentially any desired cooking areas. They may in particular be induction hobs, gas hobs, teppanyaki hobs, hobs for a wok, electrical hobs or hotplates, grills or other cooking areas.

Figure 1:
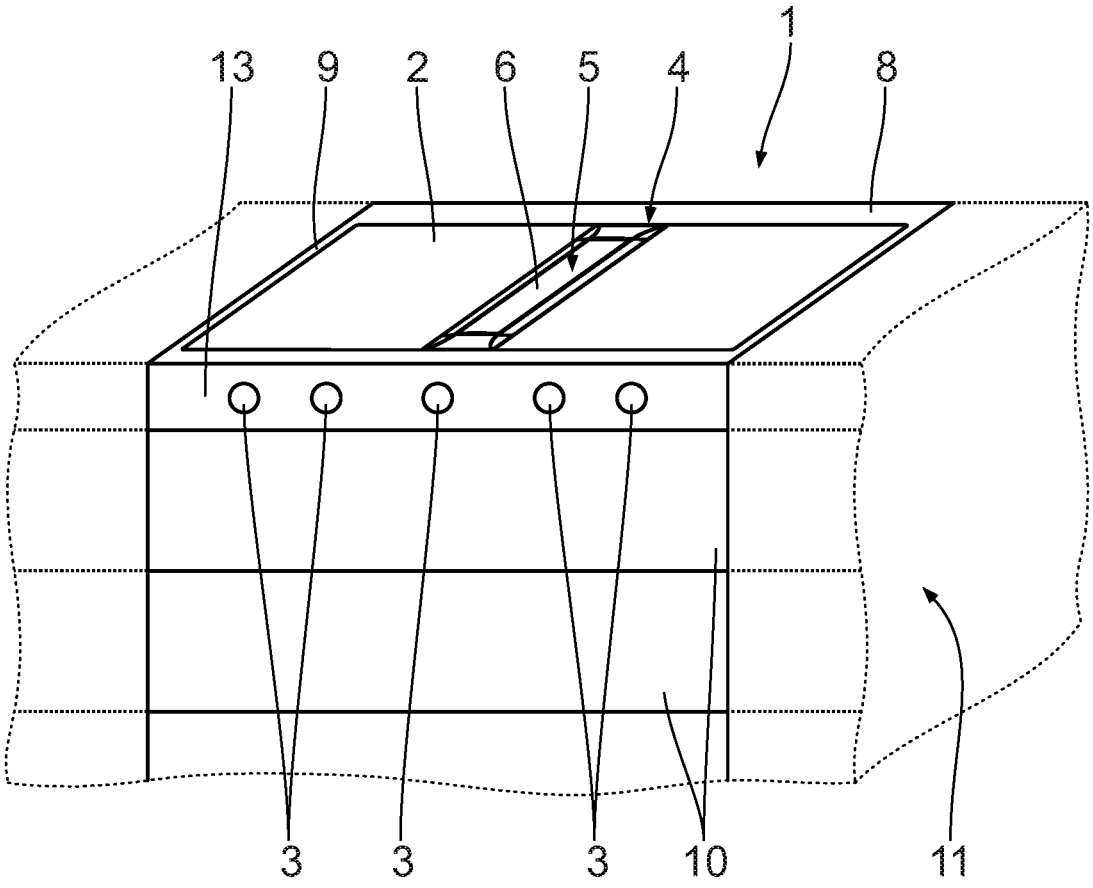
FIG. 1 is a schematic view of a hob extractor system with two hobs and an extractor fan device in the form of a downdraft extractor fan.

In the case of the alternative that is represented by way of example in FIG. 1, operating knobs 3 are respectively provided for operating the hobs 2. Operation by means of touch-sensitive sensors, which may in particular be integrated in the hobs 2, is similarly possible. Operation by means of a separate operating module is also conceivable. In this case, the hobs 2 may be designed as non-autonomous, i.e. without control electronics of their own. This allows the construction of the hobs 2 be simplified. It is possible in particular to reduce the overall height of the hobs 2. They may be in particular at most 10 cm, in particular at most 6 cm, in particular at most 5 cm, in particular at most 4 cm, in particular at most 3 cm, in particular at most 2 cm.

The hob extractor system 1 also comprises a downdraft extractor fan 4. The downdraft extractor fan 4 forms a device for extracting cooking fumes.

Figure 2:
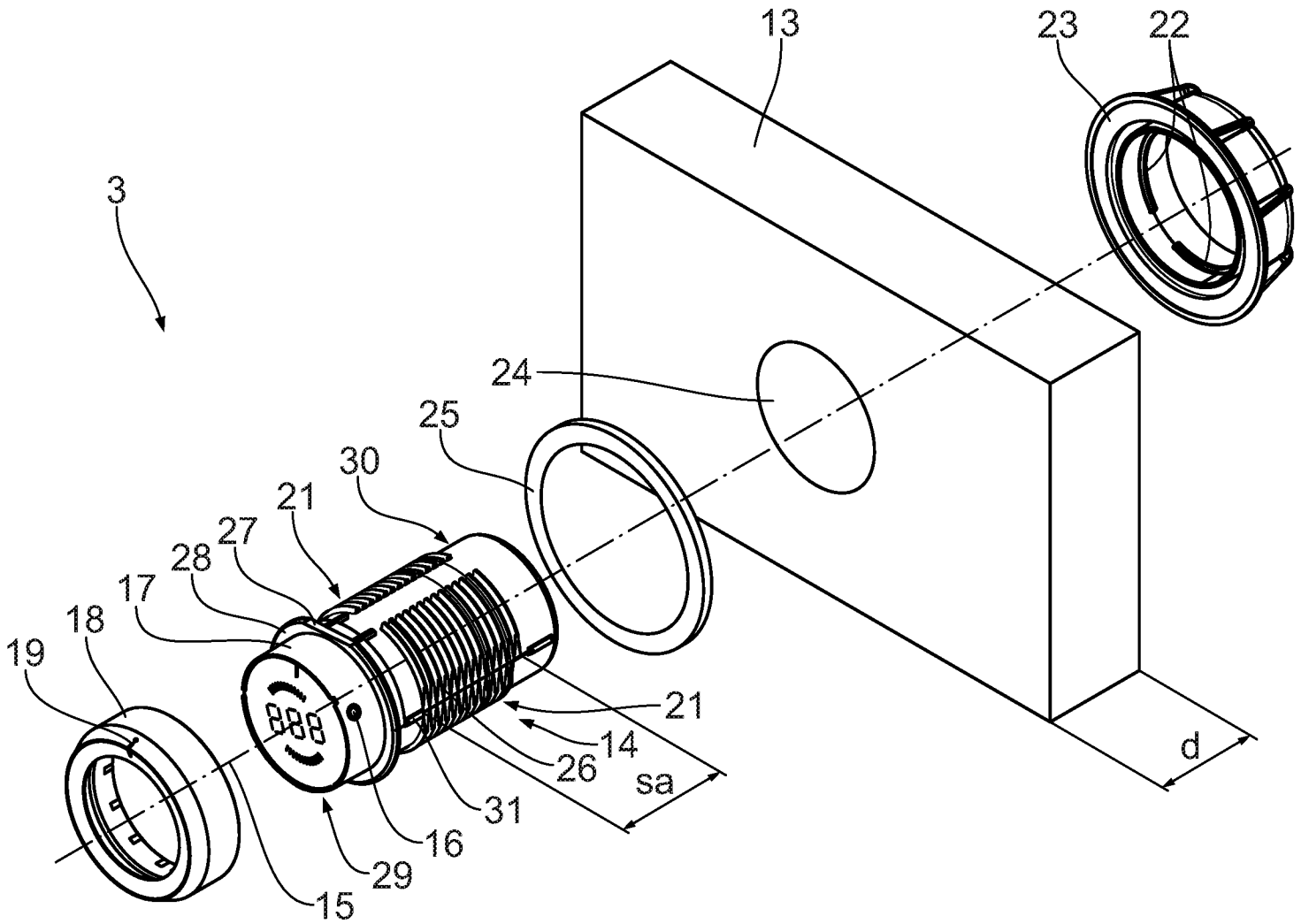
FIG. 2 is a schematic view for explaining the arrangement of an operating knob for operating the hob extractor system according to FIG. 1 in a front panel of a kitchen unit.

In the case of the alternative represented in FIG. 2, the downdraft extractor fan 4 is arranged between the two hobs 2. It may also be arranged to the side of the hobs 2 or in the region behind the hobs 2.

The downdraft extractor fan 4 has a cooking-fume inlet opening 5. In the case of the alternative represented, the cooking-fume inlet opening 5 is designed as elongate, in particular rectangular. The cooking-fume inlet opening 5 has in particular an aspect ratio of at least 2:1, in particular at least 3:1, in particular at least 5:1, in particular at least 10:1. Usually, the aspect ratio of the cooking-fume inlet opening 5 is at most 100:1, in particular at most 50:1.

The cooking-fume inlet opening 5 may also be designed as round, in particular circular.

There may also be a number of cooking-fume inlet openings 5 provided. It is in particular possible to provide two or more cooking-fume inlet openings 5, in particular slit-shaped cooking-fume inlet openings 5. These may in particular be aligned parallel to one another.

The cooking-fume inlet opening 5 is in particular reversibly closable by means of a closure element 6. In the case of a number of cooking-fume inlet openings 5, they may in each case be reversibly closable separately, i.e. independently of one another, by means of closure elements 6.

A further operating knob 3 is provided for operating the downdraft extractor fan 4. Operation by means of a touch-sensitive sensor is similarly possible.

The downdraft extractor fan 4 is arranged in particular in the region of a hob level 8. It serves for extracting cooking fumes from the region above the hob level 8 into a region below the hob level 8. It is therefore also referred to as a downdraft system (extraction in the downward direction).

The cooking-fume inlet opening 5 is preferably arranged fixed in place in relation to the hob level 8.

According to an alternative that is not represented in the figures, the region of the downdraft extractor fan 4 with the cooking-fume inlet opening 5 is displaceable in a direction perpendicular to the hob level 8.

In principle, the hob extractor system 1 may also comprise a fume-extractor hood.

The hob system 1 may be designed as an assembly unit. In this case, one or more hobs 2 with one or more downdraft extractor fans 4 are integrated in a single system. They are in particular arranged in a common housing. For assembly, this merely has to be inserted into a clearance in a worktop 9.

In the region under the hob system 1, compartments, in particular drawers 10 of a kitchen base unit 11, can be used essentially without any restriction.

The hob system 1 is of a modular design. In this case, essentially freely selectable hobs 2 can be flexibly combined with one or more of the downdraft extractor fans 4. Here, in particular, all of the hobs 2 can be operated, that is to say controlled, with operating knobs 3 described in more detail below. The downdraft extractor fan or fans 4 can also be operated, that is to say controlled, here with operating knobs 3.

The operating knobs 3 are likewise of a modular design. They are in each case connected via an interface 12 to one of the hobs 2 and/or the downdraft extractor fan 4. They are in particular in signal connection with one or more of the hobs 2 and/or the downdraft extractor fans 4.

The operating knobs 3 are in particular of a standardized design. This should be understood as meaning that the same operating knob 3 is suitable for operating different hobs 2 and/or downdraft extractor fans 4. As described in more detail below, the operating knobs 3 are designed as self-configuring. This should be understood as meaning that, when one of the hobs 2 and/or the downdraft extractor fans 4 is connected, they automatically detect which built-in kitchen appliance is concerned and their functionality is adapted correspondingly.

Such a uniform, standardized construction of the operating knobs 3 facilitates their production. What is more, it makes easy exchangeability of the operating knobs 3 possible. Finally, the assembly of the hob extractor system 1 is thereby facilitated.

In the following, some aspects of the external construction of the operating knob 3 and its arrangement in a front of a unit of furniture 13 of the kitchen base unit 11 are described with reference to FIG. 2.

The operating knob 3 comprises a central piece 14 and an operating element arranged on the latter. The operating element is mounted rotatably on the central piece 14. It is in particular mounted rotatably about a central longitudinal axis 15.

The operating element is in particular designed as an operating ring, which is also referred to as a knob ring 18.

The operating element can be removed from the central piece 14. For play-free arrangement of the operating element on the central piece 14, one or more thrust pieces 16 are provided. They are in particular resilient thrust pieces 16. They protrude slightly beyond an outer contour 17 of the central piece 14 in a radial direction in relation to the longitudinal axis 15. The outer contour 17 is designed as slightly conical. It may also be designed in the form of a shell of a circular cylinder.

A thrust piece 16 is provided in particular for predefining certain lock-in positions of the knob ring 18.

By arranging at least three thrust pieces 16, evenly distributed over the circumference of the central piece 14, a defined pulling-off force can be achieved for removing the knob ring 18 from the central piece 14.

The design of the knob ring 18 that is represented in the figures should not be understood as restrictive. The knob ring 18 may have a smooth surface. It may also have a structured surface. It may also be provided with one or more markings 19.

The central piece 14 encloses a receiving space 20. In encloses the receiving space 20 in particular in the radial direction, that is to say in a direction perpendicular to the longitudinal axis 15.

The central piece 14 is in particular made of plastic, for example of PC-ABS.

The knob ring 18 is preferably made of metal, in particular of stainless steel. It may in particular be stainless steel with the material number 1.4301 or 1.4305. Other materials are similarly possible. The knob ring 18 may in particular also be made of an electrically insulating material.

The central piece 14 is of a multipart design. It has in particular a front part 29 and a rear part 30.

In the installed state of the operating knob 3, the front part 29 protrudes forward beyond the front of the unit of furniture 13.

In the installed state of the operating knob 3, the rear part 30 is arranged in the clearance 24 in the front of the unit of furniture 13. It protrudes rearwardly beyond the front of the unit of furniture 13 in the direction of the longitudinal axis 15.

The rear part 30 of the central piece 14 can be opened, in particular can be swung open. It comprises in particular two half-shells, which are connected to one another by means of film hinges 31.

Making the rear part 30 of the central piece 14 able to swing open makes it easier to arrange electrical and/or electronic components in the receiving space 20.

The central piece 14 forms a mounting box for installing the operating knob 3 in the front of a unit of furniture 13. For this, an external-thread ridge portion 21 is provided on the outer side of the of the central piece 14. The external-thread ridge portion 21 extends in the direction of the longitudinal axis 15 over an adapting distance sa. The adapting distance sa has in particular a length in the direction of the longitudinal axis 15 in the range from 10 mm to 60 mm.

As represented in FIG. 2, in each case two external-thread ridge portions 21 are preferably formed on the central piece 14, spaced apart from one another on the circumference. These together form an external thread.

Complementing the external thread, an internal thread with internal-thread ridge portions 22 is arranged in a fixing means designed as a union nut 23. The union nut 23 can consequently be screwed onto the external thread of the central piece 14. As a result, the central piece 14 can be fixed in an easy way in a clearance 24 in the front of a unit of furniture 13. On account of the adapting distance sa, the central piece 14, and consequently the operating knob 3, can in particular be arranged very easily in fronts of units of furniture 13 with different thicknesses d.

In the region of the front side of the front of the unit of furniture 13, a spacing or sealing ring 25 may also be arranged between the central piece 14 and the front of the unit of furniture 13. It is also possible to dispense with this.

The ridges of the external-thread ridge portions 21 have in each case a flattening 26. The flattenings 26 make it possible for the rear part 30 of the central piece 14 to be able to swing open.

A flattening 27 may be provided in the region of an abutting ring 28. The abutting ring 28 serves as a supporting projection, by means of which the central piece 14 is supported on the front of the unit of furniture 13. The abutting ring 28 has one or more flattenings 27. The flattenings 27 serve in particular as an abutting edge for placing a spirit level. This makes it easier for the operating knob 3 to be precisely aligned in the front of the unit of furniture 13.

According to an advantageous alternative that is not represented in the figures, the abutting ring 28 may be of a hexagonal or octagonal design.

In the following, further details of the operating knob 3 are described with reference to FIGS. 3 and 4. Arranged in the receiving space 20 is a printed circuit board 32. The printed circuit board 32 comprises control electronics of a control device for controlling and operating the hobs 2 and/or the downdraft extractor fans 4.

The printed circuit board 32 is in particular arranged horizontally in the receiving space 20.

At its rear end, it has the interface 12 or is connected to it in a signal-transmitting manner.

Figure 3:
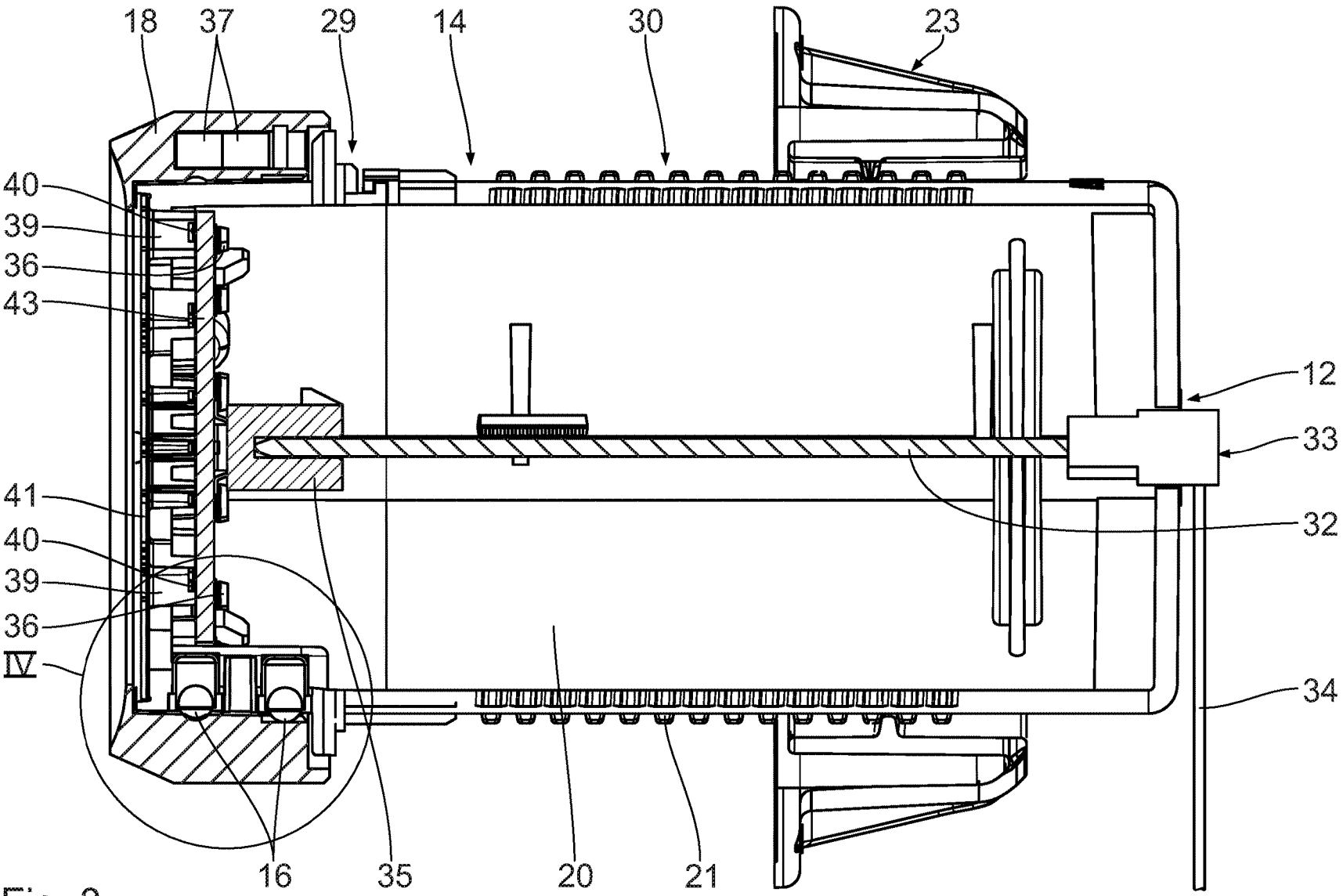
FIG. 3 is a sectional view through an operating knob according to FIG. 2.
Figure 4:
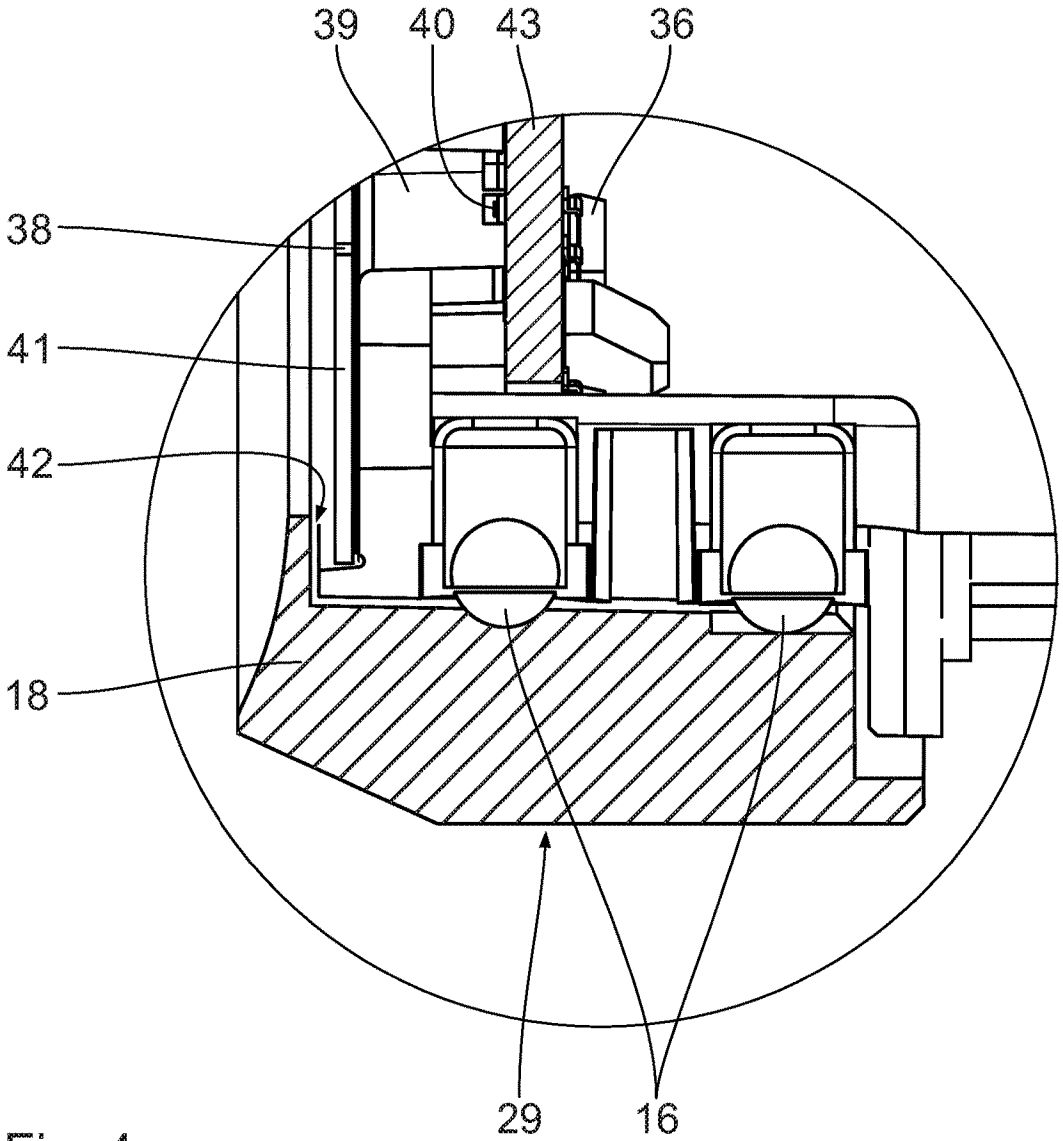
FIG. 4 is an enlarged view of a detail of the region IV from FIG. 3.

As schematically indicated in FIG. 3, a connecting cable 34 is connected to the interface 12 by means of a plug 33.

According to one alternative, a transmitting device for the wireless transmission of signals, in particular control signals, from the operating knob 3 to one or more of the hobs 2 and/or one or more of the downdraft extractor fans 4 may be provided in addition or as an alternative to the interface 12. Such a transmitting device is preferably arranged in the rearward part of the central piece 14. By means of a corresponding transmitting device, the arrangement of the operating knob 3 is even more flexible. What is more, as a result the connection of the operating knob 3 to one of the hobs 2 and/or one of the downdraft extractor fans 4 is simplified further.

The printed circuit board 32 is connected to the so-called front board via a further interface 35, in particular in the form of an edge card interface. Placed on this board are sensors and lighting means, in particular LEDs, that are described in more detail below.

The knob ring 18 is mounted rotatably about the longitudinal axis 15. The rotational position of the knob ring 18 can be sensed by means of at least one position sensor. A Hall sensor 36 may serve in particular as the position sensor 36. The Hall sensor 36 is arranged in the receiving space 20 of the central piece 14. It may in particular be arranged on a printed circuit board in the front part 29 of the central piece 14.

Magnets 37 are arranged in the knob ring 18 to interact with the Hall sensor 36. The number of magnets 37 is in particular at least three, in particular at least five, in particular at least eight, in particular at least twelve. Some other number of magnets 37 is similarly possible. The number of Hall sensors 36 is in particular at least three, in particular at least five, in particular at least eight, in particular at least twelve. It is in particular at most 30, in particular at most 20, in particular at most 15. Some other number of Hall sensors 36 is similarly possible. The Hall sensors 36 may in particular be arranged essentially evenly distributed over the circumference of the central piece 14.

Arranged in the front part 29 of the central piece 14 is a display device. The display device comprises a plurality of light-exit openings 38. Light can be applied to the light-exit openings 38 by means of tube-like cavities 39 or light guides, with light which is emitted by a radiation source, in particular in the form of an LED 40.

The light-exit openings 38 may be made as microbores, in particular as laser bores, in a front covering 41 of the central piece 40. The front covering 41 is also referred to as an overlay. The front covering 41 may in particular be made of the same material as the knob ring 18. It is in particular provided with a coating. Serving in particular as a coating is a lacquer, in particular a lacquer against fingerprints.

The light-exit openings 38 may have on their front side, that is to say in the region that is visible from the front, a diameter in the range from 10 μm to 100 μm, in particular in the range from 20 μm to 50 μm, in particular of less than 30 μm. They may have on their rear side, facing the receiving space 20, a diameter in the range from 10 μm to 1 mm, in particular in the range from 30 μm to 200 μm, in particular of at least 50 μm.

The light-exit openings 38 may be sealed, that is to say closed, by means of a transparent potting material. This can achieve the effect of preventing dirt from getting into the receiving space 20 through the light-exit openings 38.

The light-exit openings 38 and/or the cavities 39 may be oriented as running obliquely upward. This can achieve the effect that the display device is visible from obliquely above, while directly from the front it is invisible or at least essentially invisible.

The overlay with the light-exit openings may also be provided—in particular over the entire surface area—with a metallic coating, which is so thin that light from the LEDs is allowed to pass through. For the radiation emitted by the LEDs, the coating has a transmittance of at least 30%, in particular at least 50%, in particular at least 70%, in particular at least 80%. Under this coating, the light-exit openings 38 and/or the cavities 39 are invisible. The coating may comprise a metal oxide layer. It may in particular form a one-way mirror.

The front covering 41 forms an operating zone, which is coupled to a touch-sensitive sensor device. The operating knob 3 consequently has what is known as touch functionality. The front covering 41 may in particular be designed as a so-called touchscreen (touch-sensitive screen). In this case, it is also possible to dispense with the light-exit openings 38.

The control electronics for the touchscreen may be arranged on a printed circuit board 43. The printed circuit board 43 is connected to the printed circuit board 32 via the edge card interface 35. The printed circuit board 43 is in particular arranged vertically in the receiving space 20.

By touching the front covering 41, specific functions of the hobs 2 and/or the downdraft extractor fans 4 can be controlled.

The touchscreen may be of a resistive, capacitive or inductive design.

The knob ring 18 is arranged at a distance from the front covering 41. In particular, a gap 42 is provided between the knob ring 18 and the front covering 41. The gap 42 serves for producing an anti-capillary effect. It prevents moisture from establishing an electrical connection between the front covering 41 and the knob ring 18.

According to one alternative, in the case of the operating knob 3, arranged in the central region behind the front covering 41 is a touch-sensitive or pressure-sensitive sensor, in particular in the form of a piezo sensor or a capacitive sensor.

The individual details of the alternatives described above, in particular the details of the arrangement of the knob ring 18 on the central piece 14, the details of the touch-sensitive sensor, the details of the pressure-sensitive sensor and the details of the display device, can essentially be freely combined with one another.

While specific embodiments of the invention have been shown and described in detail to illustrate the application of the principles of the invention, it will be understood that the invention may be embodied otherwise without departing from such principles.

The invention claimed is:

1. A device for operating a built-in kitchen appliance, the device comprising:

a central piece;

an operating element mounted rotatably on the central piece;

at least one position sensor configured for sensing a rotational position of the operating element;

at least one sensor, the at least one sensor being at least one of touch-sensitive and pressure-sensitive; and an operating zone with a display in the form of a screen for displaying at least one operating parameter for operating the built-in kitchen appliance, the central piece being formed by a built-in mounting box for arrangement in one of a front of a kitchen unit and a kitchen worktop, the central piece comprising an installation receiving space for receiving electrical components, the at least one sensor being arranged in the installation receiving space and being in signal connection with the operating zone, the operating element being configured in a form of a ring circumferentially surrounding the operating zone, wherein the at least one sensor is in signal connection with the operating zone, the central piece being configured to extend through an opening in one of the kitchen unit and the kitchen worktop, the central piece comprising a plurality of thread ridge portions configured for connecting the central piece to the one of the kitchen unit and the kitchen worktop, at least one of the plurality of thread ridge portions comprising a flattened portion.

2. The device as claimed in claim 1, wherein the central piece forms at least one of a leading-through means and a fixing means for an arrangement of the device in a piece of furniture, the installation receiving space being configured to receive a circuit board.

3. The device as claimed in claim 1, wherein the operating element is removable from the central piece, the central piece comprising a first central piece portion and a second central piece portion, the first central piece portion and the second central piece portion defining at least a portion of the installation receiving space, the first central piece portion being movably connected to the second central piece portion via a hinge connection.

4. The device as claimed in claim 1, further comprising an interface device for a signal-transmitting connection to at least one of a hob and an extractor fan device.

5. The device as claimed in claim 1, wherein the operating element is located at a spaced location from the operating zone.

6. The device as claimed in claim 1, wherein a portion of the operating element and a portion of the operating zone define a gap.

7. A device for operating a built-in kitchen appliance, the device comprising:

a central piece;

an operating element mounted rotatably on the central piece;

at least one position sensor configured for sensing a rotational position of the operating element;

at least one sensor, the at least one sensor being at least one of touch-sensitive and pressure-sensitive; and an operating zone with a display in the form of a screen for displaying at least one operating parameter for operating the built-in kitchen appliance, the central piece being formed by a built-in mounting box for arrangement in one of a front of a kitchen unit and a kitchen worktop, the central piece comprising an installation receiving space for receiving electrical components, the at least one sensor being arranged in the installation receiving space and being in signal connection with the operating zone, the operating element being configured in a form of a ring circumferentially surrounding the operating zone, wherein the operating element is located at a spaced location from the operating zone.

8. A device for operating a built-in kitchen appliance, the device comprising:

a central piece;

an operating element mounted rotatably on the central piece;

at least one position sensor configured for sensing a rotational position of the operating element;

at least one sensor, the at least one sensor being at least one of touch-sensitive and pressure-sensitive; and an operating zone with a display in the form of a screen for displaying at least one operating parameter for operating the built-in kitchen appliance, the central piece being formed by a built-in mounting box for arrangement in one of a front of a kitchen unit and a kitchen worktop, the central piece comprising an installation receiving space for receiving electrical components, the at least one sensor being arranged in the installation receiving space and being in signal connection with the operating zone, the operating element being configured in a form of a ring circumferentially surrounding the operating zone, wherein a portion of the operating element and a portion of the operating zone define a gap.

* * * * *